US009332843B2

(12) United States Patent
Jang

(10) Patent No.: US 9,332,843 B2
(45) Date of Patent: May 10, 2016

(54) SITTING TYPE SHAMPOO CHAIR

(71) Applicant: Myung Su Jang, Seoul (KR)

(72) Inventor: Myung Su Jang, Seoul (KR)

( * ) Notice: Subject to any disclaimer, the term of this patent is extended or adjusted under 35 U.S.C. 154(b) by 0 days.

(21) Appl. No.: 14/421,686

(22) PCT Filed: Aug. 1, 2013

(86) PCT No.: PCT/KR2013/006954
§ 371 (c)(1),
(2) Date: Feb. 13, 2015

(87) PCT Pub. No.: WO2014/027774
PCT Pub. Date: Feb. 20, 2014

(65) Prior Publication Data

US 2015/0230607 A1 Aug. 20, 2015

(30) Foreign Application Priority Data

Aug. 17, 2012 (KR) ..... 10-2012-0089973
Jul. 30, 2013 (KR) ..... 10-2013-0090089

(51) Int. Cl.

| | |
|---|---|
| ***A47C 1/035*** | (2006.01) |
| ***A47C 1/0355*** | (2013.01) |
| ***A47C 7/50*** | (2006.01) |
| ***A47C 20/00*** | (2006.01) |
| ***A47C 1/024*** | (2006.01) |
| ***A47C 1/06*** | (2006.01) |
| ***A45D 44/02*** | (2006.01) |

(52) U.S. Cl.
CPC ..... *A47C 1/024* (2013.01); *A45D 44/02* (2013.01); *A47C 1/06* (2013.01)

(58) Field of Classification Search
CPC ..... A47C 1/024; A47C 1/06; A45D 44/02
USPC ..... 297/68, 69, 83, 84, 342, 423.28
See application file for complete search history.

(56) References Cited

U.S. PATENT DOCUMENTS

| | | | | | |
|---|---|---|---|---|---|
| 3,858,938 | A * | 1/1975 | Kristensson | A61G 5/006 | 297/68 X |
| 4,131,960 | A * | 1/1979 | Quakenbush | A47C 17/1756 | 297/342 |
| 4,455,050 | A * | 6/1984 | Kubek | A61G 5/12 | 297/423.28 X |
| 4,563,784 | A * | 1/1986 | Shrock | A47C 17/17 | 297/342 |
| 4,625,346 | A * | 12/1986 | Quackenbush | A47C 17/161 | 297/342 |
| 4,937,900 | A * | 7/1990 | Bridges | A47C 1/0342 | 297/342 X |
| 5,348,367 | A * | 9/1994 | Mizelle | A47C 1/035 | 297/83 X |
| 5,823,614 | A * | 10/1998 | Johnson | A47C 1/0355 | 297/68 X |
| 5,868,461 | A * | 2/1999 | Brotherston | A47C 17/1756 | 297/84 X |
| 5,931,535 | A * | 8/1999 | Sweet | A47C 1/0345 | 297/68 X |
| 5,971,475 | A * | 10/1999 | Lawson | A47C 1/0355 | 297/68 |
| 6,612,650 | B1 * | 9/2003 | Ambrosio | A47C 1/035 | 297/68 X |
| 6,616,232 | B2 * | 9/2003 | Herman | A47C 1/0342 | 297/68 X |

(Continued)

FOREIGN PATENT DOCUMENTS

| | | | | |
|---|---|---|---|---|
| DE | 3234836 | A1 * | 3/1984 | A47C 1/035 |
| JP | 08-103342 | A | 4/1996 | |

(Continued)

*Primary Examiner* — Rodney B White
(74) *Attorney, Agent, or Firm* — Novick, Kim & Lee, PLLC; Jae Youn Kim

(57) ABSTRACT

A shampoo chair having a seat is provided. When a back of the chair is pushed backwards, a leg support is concurrently lifted up in conjunction with the back of the chair such that a client washing his or her hair can receive a shampoo service in a more comfortable way.

7 Claims, 14 Drawing Sheets

(56) References Cited

U.S. PATENT DOCUMENTS 6,855,098 B2 * 2/2005 Reitz ..... A63B 23/035 297/68 X
6,945,596 B2 * 9/2005 Huang ..... A47C 1/035 297/68 X
6,974,186 B1 * 12/2005 Chang ..... A47C 1/035 297/68 X
7,011,362 B1 * 3/2006 Huang ..... A47C 1/035 297/68 X
7,080,887 B2 * 7/2006 Tseng ..... A47C 1/035 297/69 X
7,134,713 B1 * 11/2006 Tseng ..... A47C 1/0347 297/68 X
7,311,359 B2 * 12/2007 Smith ..... A47C 1/0244 297/68 X
7,445,279 B2 * 11/2008 Crum ..... A47C 1/0355 297/68
7,503,624 B2 * 3/2009 Hoffman ..... A47C 1/0242 297/68 X
7,611,207 B2 * 11/2009 Barfuss ..... A47C 1/06 297/423.28 X
7,828,756 B2 * 11/2010 Kamba ..... A61H 1/003 297/68 X
8,534,758 B2 * 9/2013 Rivera ..... A47C 1/03294 297/342
8,550,558 B2 * 10/2013 Fu ..... A47C 1/03238 297/342 X
2010/0132118 A1 * 6/2010 Robertson ..... A47C 1/0342 297/68 X
2010/0171343 A1 * 7/2010 Asbjornsen ..... A47C 1/035 297/69
2010/0320809 A1 * 12/2010 Roleder ..... A47C 1/0342 297/69
2011/0043005 A1 * 2/2011 Fischer ..... A47C 7/506 297/68
2011/0043006 A1 * 2/2011 Butt ..... A47C 7/38 297/68
2013/0341974 A1 * 12/2013 Ishikawa ..... A47C 7/506 297/68
2014/0145476 A1 * 5/2014 Nagayasu ..... B60N 2/22 297/68 X
2014/0239675 A1 * 8/2014 Besler ..... A47C 1/035 297/68
2015/0035322 A1 * 2/2015 Lin ..... A47C 1/03255 297/84
2015/0130241 A1 * 5/2015 Rivera ..... A47C 1/03294 297/342

FOREIGN PATENT DOCUMENTS

JP 09-271422 A 10/1997
JP 10-229924 A 9/1998
JP 2005-152574 A 6/2005
JP 2009-268711 A 11/2009
KR 20-0340270 Y1 1/2004
KR 20-0382546 Y1 4/2005
KR 20-0416569 Y1 5/2006

* cited by examiner

SITTING TYPE SHAMPOO CHAIR

BACKGROUND OF THE INVENTION

1. Field of the Invention

The present invention is a shampoo chair, enabling a client lie in a position with his or her head bent back when washing hair in a salon, more specifically, which is a sitting type shampoo chair, making a client being shampooed in a more comfortable position by letting leg support raised up in conjunction with the back of the chair bent back.

And, the present invention is a sitting type shampoo chair, which enables a client being shampooed in a more comfortable position by letting the chair support raised up in conjunction with the back support bent back using its foot support.

2. Description of Related Art

In general, shampoo chairs mainly used at barber shops or salons are divided to a motor-type shampoo chair and a sitting type shampoo chair, the motor-type shampoo chair controls the height of the chair using a motor and the chair back has a similar structure as the chair for dental clinic as a structure being more slanted and becoming horizontal by operation of motor. Also the sitting type shampoo chair is equipped with a chair and a shampoo stand to shampoo behind for shampooing by having the client bend the head backward and have the face upward.

Applications of many kind of the sitting type shampoo chair have been filed in the Patent Office of Republic of Korea. One such example is Application No. 20-2003-0030829 as of Sep. 30, 2003 (The title of invention: Chair for shampooing), comprises a hip support propping up the body, an armrest installed at the left and right side of hip support and a shampoo chair equipped with the back of a chair at the back of hip support and hair washing stand positioned close to the shampoo chair, where the hip support (11) and the back of the chair (12) are equipped to be folded by shaft seal, which contains what is bent back at a slow pace by a buffer means like absorber (20) and what interlocks hip support (11), leg support (13) to the back of chair (12) by the interlocking means connecting to link (22a)(22b) with hip support (11), leg support (13) equipped to be folded by hinge (23), the body frame (15) supporting hip support (11) by being equipped at the one side of lower part of the hip support (11) and hair washing stand (16) equipped with a shower (17) at the upper part of one side of the body frame (15).

The second example, Application No. 20-2004-0030798 as of Nov. 1, 2004 (The title of invention: Chair equipped with shampoo stand as one set), comprises seat (32) equipped with vertical frame (40) in the bottom; chair back (34) positioned at the rear part of the seat (32) and with the end part connected hinged (38) one another; shampoo stand (10) equipped with ceramic ware (12) for washing hair at the top, support frame (14) supporting the ceramic ware (12) formed in the bottom; base (20) equipped with driving means having piston (44) positioned at the bottom of the seat (32), with the bottom of the support frame (14) fixed and straight back and forth motion inside; the first support shaft (42) ascending and descending drawing a locus at the time of the piston (44)'s rectilineal movement, with one part of the base (2) combined by hinge, other end part combined by hinge at one part of the vertical frame (4), at one part of center, the end part of the piston (44) combined by hinge; the second support shaft (43) ascending and descending concurrently with the ascend and descend of the first support shaft (42), positioned in parallel having height difference to the first support shaft (42) to support seat (32) for the seat (32) to ascend and descend in parallel state, with one end art combined by hinge at one part of the base (20), other end part combined by hinge at the bottom of the chair; support subsidiary materials (60) with both ends combined by hinge at one part of rear side of the chair back (34) and at one part of the support frame (14) for chair back (34) to be erected or spread horizontally at the time of ascend and descend of the seat (32).

The third is Application No. 20-2006-0005919 as of Mar. 6, 2006 (The title of invention: One set type of chair and shampoo stand, safe hair washing machine) comprises a link device (40) operated by driving means, with sitting stand (11) of chair (10) ascending by the link device, rotation spread of chair back (13) and leg support (15) linked, the driving means installed in frame (50) supporting shampoo stand (20), frame-side bracket (51) to support chair back (13) protrudingly installed at top of the frame (50), the chair back (13) combined by hinge to the frame side bracket (51), and the driving means (300) is composed of reduction actuator unit (301) with piston shaft (350) combined with screw to shaft (340) outputting motor rotation power by reduction of speed and entered or absorbed from casing (360) and the piston shaft (350) is combined to the link device (40) by hinge (350).

The fourth example, Application No. JP 2004-031118 as of Feb. 6, 2004 (The title of invention: One set type of beauty parlor and barber chair and shampoo stand, safe hair washing machine) comprises seat basic plate, seat part installed to be slided to the seat basic plate, serve chair back shaft-supported for free assembly at top of arm expansively from rear side of the seat part, rack installed at rear side of the seat part, lock pin heading for rack side gear connected and disconnected to the rack and with spring receiving strength, chair back plate with main chair back shaft-supported for free assembly at erection plate formed by erecting from the seat basic plate, gas cylinder connected to the chair back plate, with operation means such as handle shaft-supported for free assembly at the seat basic plate equipped, in gear connected state with the rack according to that the operation means is in initial position and the lock pin receives strength by spring, the chair back plate is met to direction of waist rear by weight to the practiced person's the main chair back due to free state of the gas cylinder with the operation of the operation means, at the same time, the lock pin and the rack gears disconnected, making seat part move, met to fit the practiced's waist part by the arm moving and serve chair back moving with movement of the seat part, free state of gas cylinder stops, chair back plate is locked at waist rear, lock pin and rack gears are connected and seat part is locked at moving position with return of operation means.

However, the previous shampoo chairs mentioned so far had problems that it is difficult to keep an adequate distance between the neck rest of shampoo stand (concave part supporting the neck) and the seating plate due to everybody's variation of seating height, it acts as a heavy burden to the old and weak with less muscular power due to the structure that surrounding of the neck is pulled downward by center of gravity.

DETAILED DESCRIPTION OF THE INVENTION

Technical Problem to be Solved

The present invention has improved and been made to solve problems of the previous technology. The present invention aims to provide a sitting type shampoo chair enabling a client being shampooed in a more comfortable position, as the upper part of human body is heavier than the lower part, by creating great force where the body is being slanted and becoming closer to horizontal with a structure configure to push a rotation lever by a loader with the weight when the weight is applied to the chair back.

Technical Solution

A sitting-type shampoo chair according to present invention to achieve the purpose, comprises an inverted U-shaped first leg frame (102); an inverted U-shaped second leg frame (104) positioned at a fixed distance from the inverted U-shaped first leg frame (102); a fixing stand (106) installed between a rear side of the inverted U-shaped first leg frame (102) and a rear side of the inverted U-shaped second leg frame (104); a first bump piece (108) installed on a front side of the inverted U-shaped first leg frame (102); a second bump piece (110) installed on a front side of the inverted U-shaped second leg frame (104); a first horizontal plate (112) installed on a top side of the inverted U-shaped first leg frame (102); a second horizontal plate (113) installed on a top side of the inverted U-shaped second leg frame (104); a first lateral plate (114) extending vertically to one end of the first horizontal plate (112) and installed to the first bump piece (108); a second lateral plate (116) extending vertically to one end of the second horizontal plate (113) and installed to the second bump piece (110); a support plate (118) extending horizontally to one end of the first lateral plate (114) and to one end of the second lateral plate (116), and installed on one end of the first bump piece (108) and one end of the second bump piece (110).

Useful Effect

As described above, the sitting type shampoo chair according to present invention has an effect that a person washing his or her hair receive a shampoo service in a more comfortable state by creating great force as the human body closes to horizontality with a structure pushing a loader by the weight force if a weight is applied to the back of shampoo chair and the chair support attached to the rotation lever rising based on that the upper part, that is, the upper part of waist is heavier than the lower leg part.

The present invention has an effect that a person getting shampooed in a more comfortable position by creating great force as the human body closes to horizontality with a structure pushing the chair support through a vertical loader and the chair support rising by operating the second slant loader if a weight is applied to the back part of shampoo chair.

DETAILED DESCRIPTION OF THE INVENTION

Figure 1:
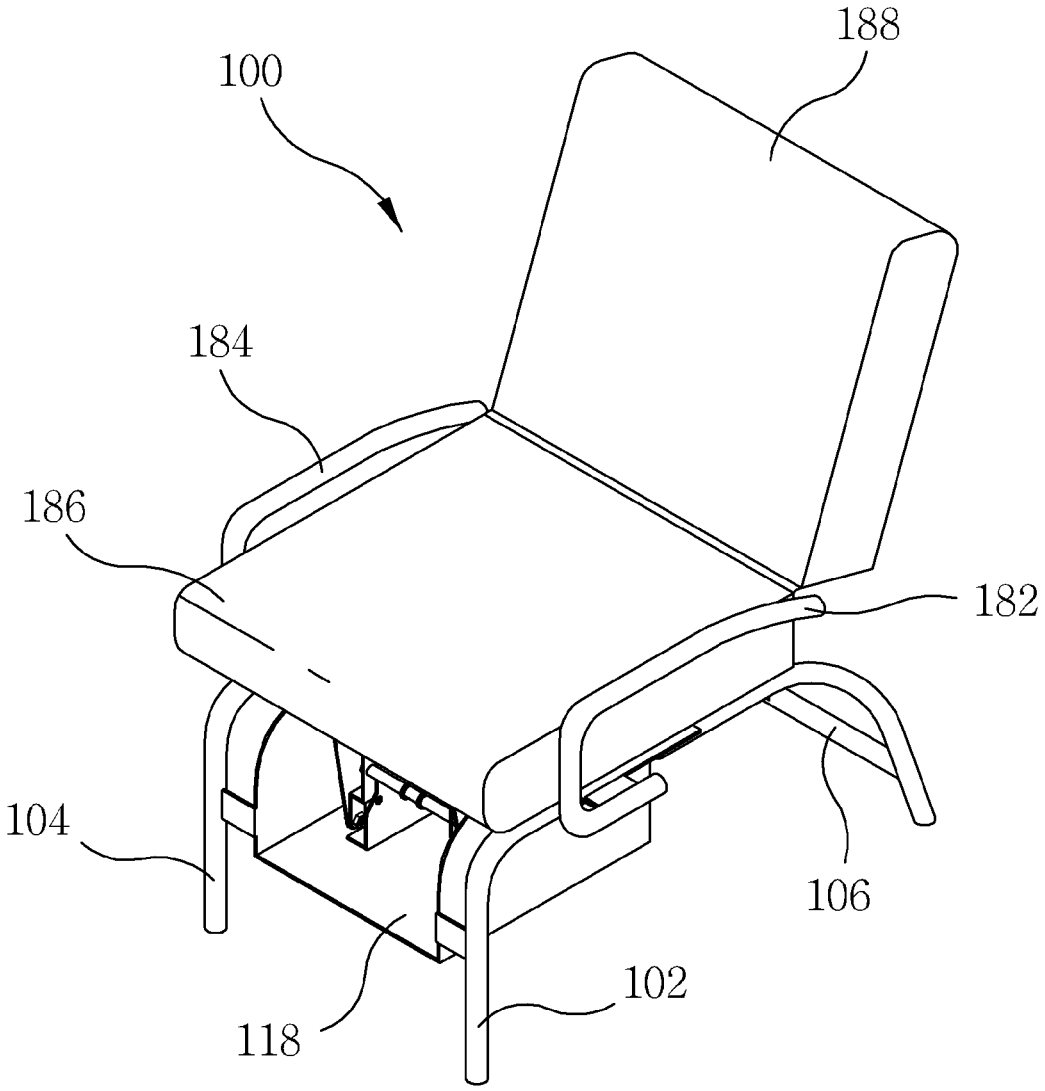
FIG. 1 is a perspective view of the sitting type shampoo chair according to the present invention.
Figure 2:
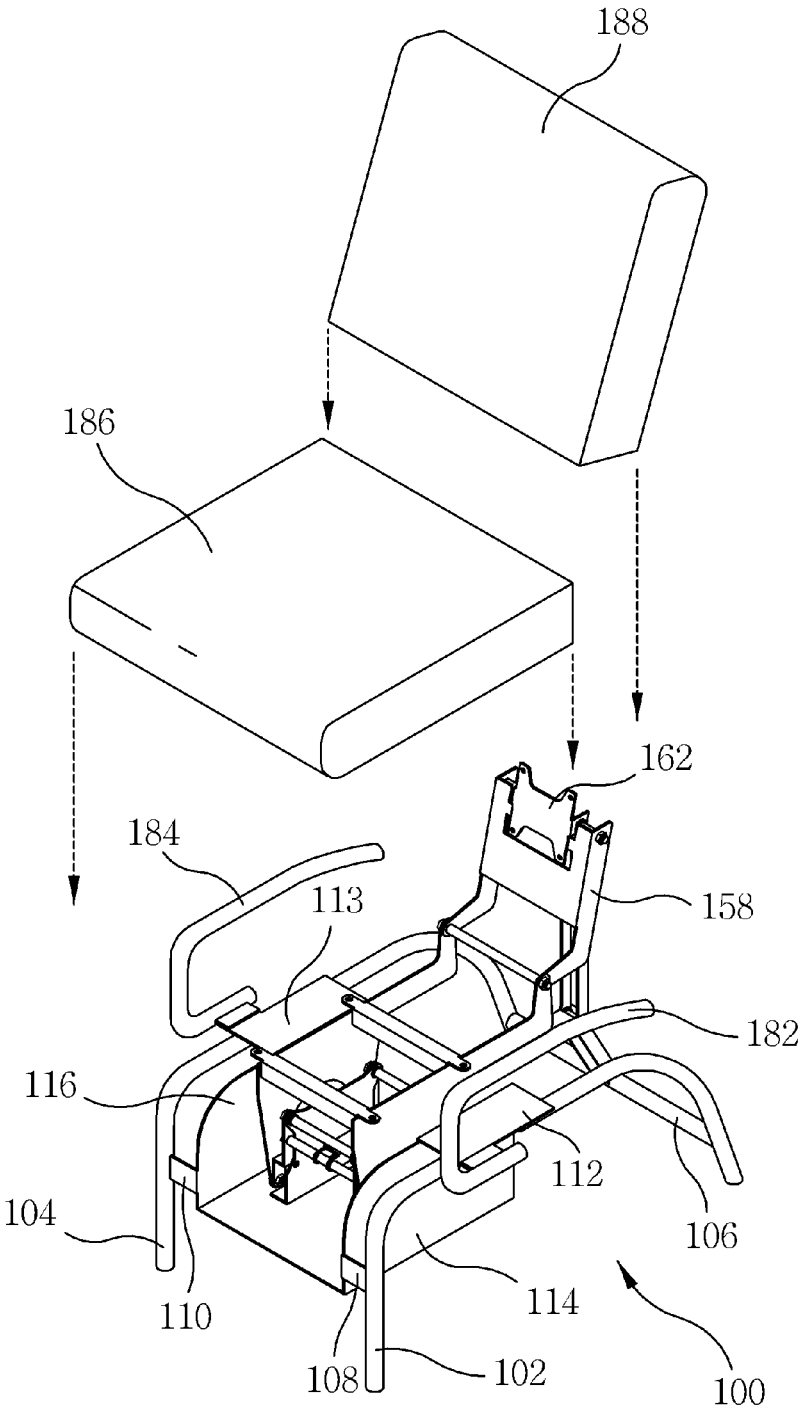
FIG. 2 is a partially exploded view of the sitting type shampoo chair according to the present invention.
Figure 3:
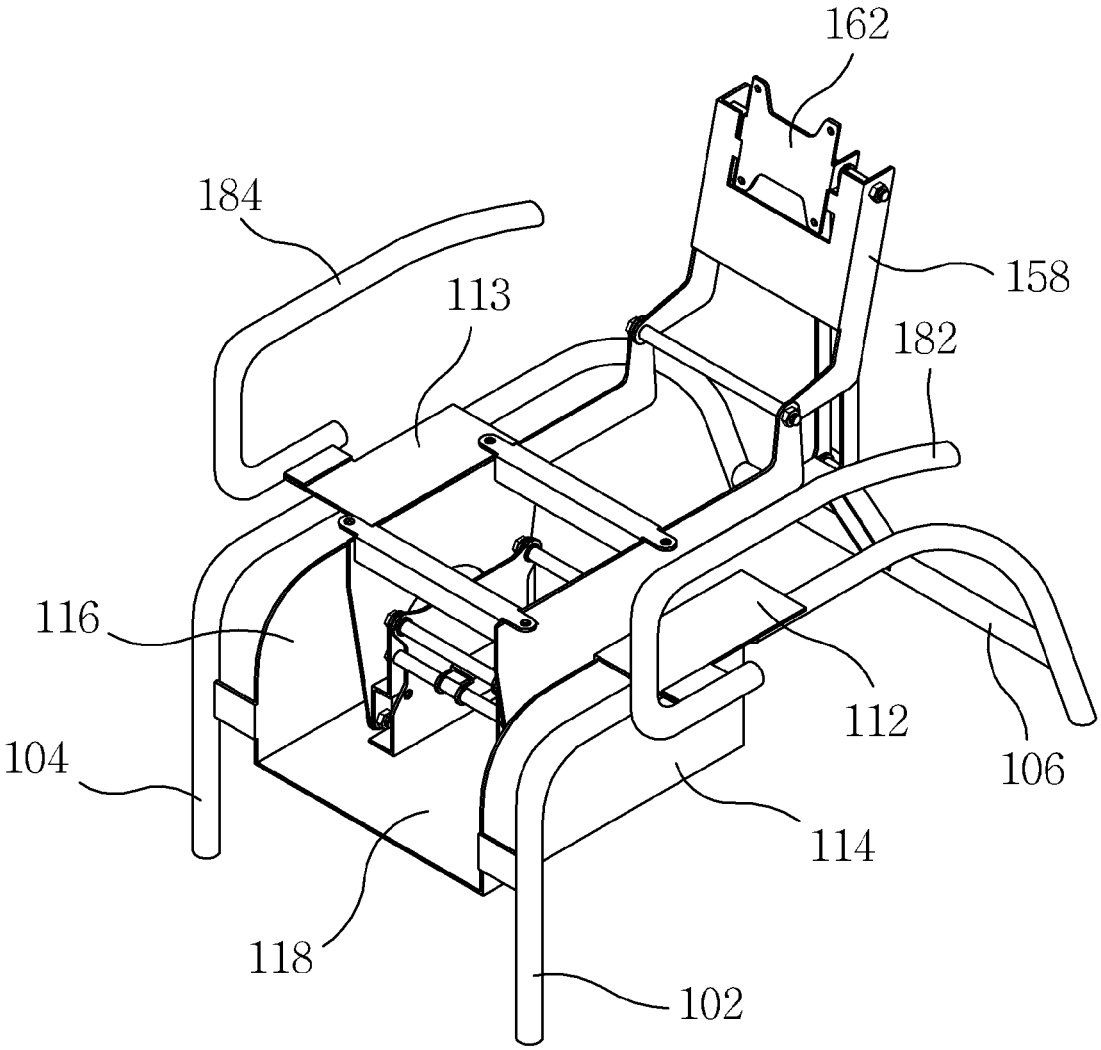
FIG. 3 is a partially exploded view of the frame of the sitting type shampoo chair.
Figure 4:
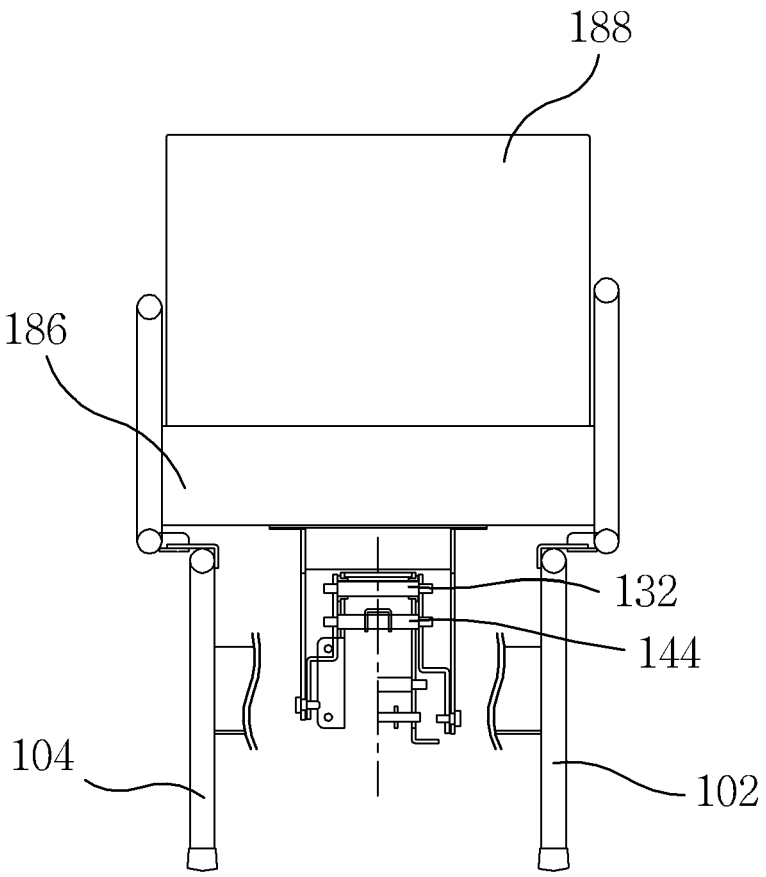
FIG. 4 is a different view of the frame of the sitting type shampoo chair of FIG. 1.
Figure 5:
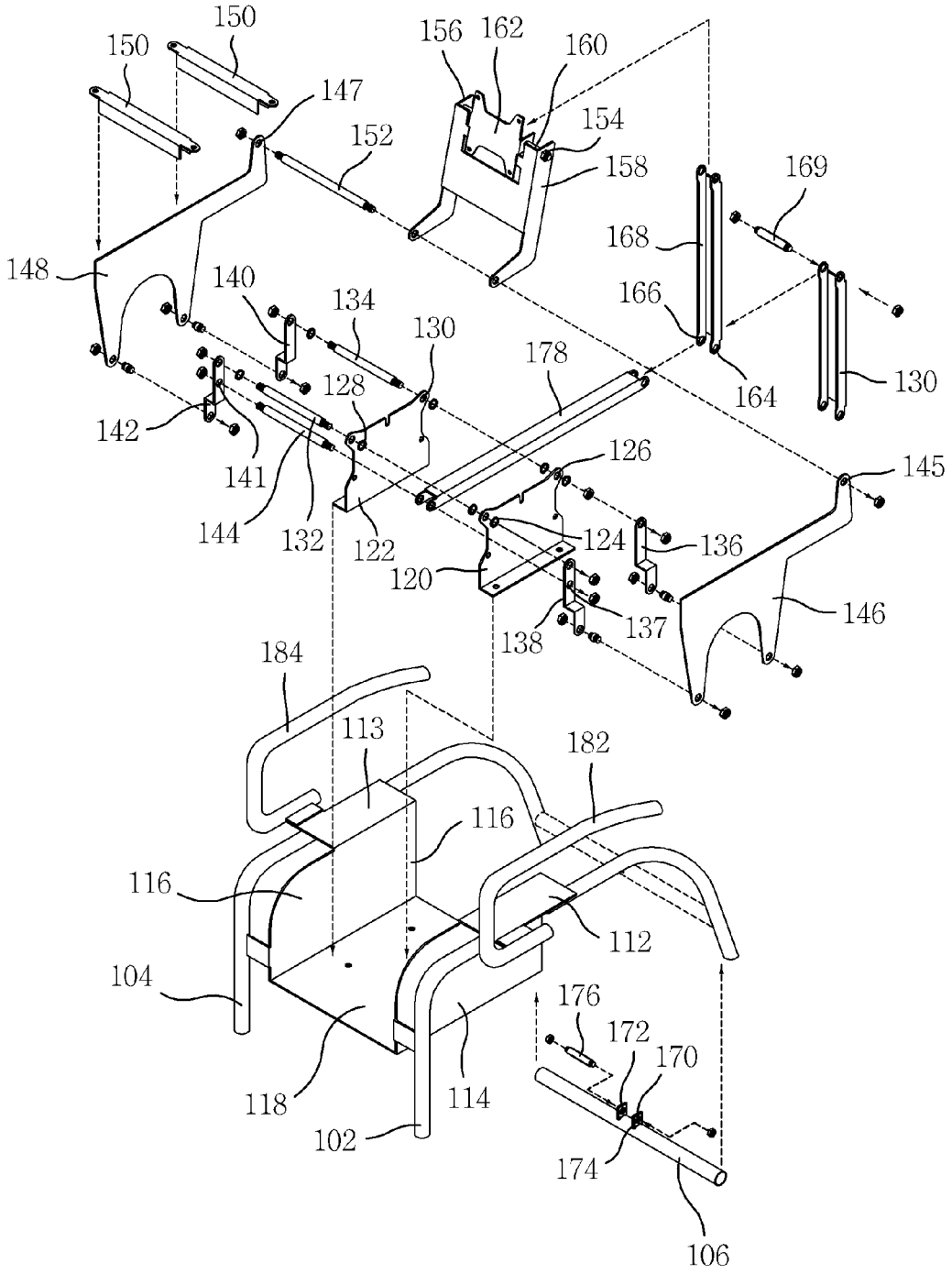
FIG. 5 is an exploded view of FIG. 1.

FIG. 1 is a perspective view of the sitting type shampoo chair according to the present invention. FIG. 2 is a partially exploded view of the sitting type shampoo chair according to the present invention. FIG. 3 is a partially exploded view of the frame of the sitting type shampoo chair. FIG. 4 is a different view of the frame of the sitting type shampoo chair of FIG. 1. FIG. 5 is an exploded view of FIG. 1.

As illustrated in FIGS. 1 and 5, the sitting type shampoo chair according to the present invention includes an inverted U-shaped first leg frame (102); an inverted U-shaped second leg frame (104) positioned at a fixed distance from the inverted U-shaped first leg frame (102); a fixing stand (106) installed between a rear side of the inverted U-shaped first leg frame (102) and a rear side of the inverted U-shaped second leg frame (104); a first bump piece (108) installed on a front side of the inverted U-shaped first leg frame (102); a second bump piece (110) installed on a front side of the inverted U-shaped second leg frame (104); a first horizontal plate (112) installed on a top side of the inverted U-shaped first leg frame (102); a second horizontal plate (113) installed on a top side of the inverted U-shaped second leg frame (104); a first lateral plate (114) extending vertically to one end of the first horizontal plate (112) and installed to the first bump piece (108); a second lateral plate (116) extending vertically to one end of the second horizontal plate (113) and installed to the second bump piece (110); a support plate (118) extending horizontally to one end of the first lateral plate (114) and to one end of the second lateral plate (116), and installed on one end of the first bump piece (108) and one end of the second bump piece (110); a first vertical plate (120) installed on an upper part of the support plate (118); a second vertical plate (122) located at a fixed distance from the first vertical plate (120) and installed on the upper part of the support plate (118); a first penetration hole (124) and a second penetration hole (126) located at a fixed distance on a top side of the first vertical plate (120); a third penetration hole (128) located at a top side of the second vertical plate (122) corresponding to the first penetration hole (124) on the first vertical plate (120); a fourth penetration hole (130) located at the top side of the second vertical plate (122) corresponding to the second penetration hole (126) of the first vertical plate (120); a first shaft (132) inserted and fixed to the first penetration hole (124) and to the third penetration hole (128); a second shaft (134) inserted and fixed to the second penetration hole (126) and to the fourth penetration hole (130); a first rotation lever (136) installed rotatably at the end of one side of the second shaft (134); a second rotation lever (138) installed rotatably at the end of one side of the first shaft (132) and having a fifth penetration hole (137) located at the center thereof; a third rotation lever (140) installed rotatably at the end of the other side of the second shaft (134); a fourth rotation lever (142) having a sixth penetration hole (141) corresponding to the fifth penetration hole (137) of the second rotation lever (138) and located at the center thereof; a third shaft (144) inserted and fixed to the fifth penetration hole (137) and the sixth penetration hole (141); a first guide (146) positioned between the first lateral plate (114) and the first vertical plate (120), installed between the first rotation lever (136) and the second rotation lever (138), configured to be moved by operation of the first and the second rotation levers (136) (138) and having a seventh penetration hole (145) at the end of thereof; a second guide (148) positioned between the second lateral plate (116) and the second vertical plate (122), configured to be moved by operation of the third and the fourth rotation levers (140) (142), and having a eighth penetration hole (147) at an end of thereof, wherein the third rotation lever (140) and the fourth rotation lever (142) are fixed to the second guide and; a chair support (150) installed at a fixed distance on a top side of the first guide (146) and on a top side of the second guide (148); a fourth shaft (152) inserted and fixed into the seventh penetration hole (145) and into the eight penetration hole (147); a "L" shaped chair back support (158) installed rotatably at one end of the fourth shaft (152), and having a ninth and a tenth penetration holes (154)(156) at the edge thereof; a fifth shaft (160) inserted and fixed at the ninth penetration hole (154) and the tenth penetration hole (156); a chair back plate (162) configured to be rotated at the fifth shaft (160); a first loader (168) installed rotatably and vertically with a fixed length on the fifth shaft (160) and configured to move the chair back plate (162) and having an eleventh and a twelfth penetration holes (164)(166) at the edge thereof; a sixth shaft (169) inserted and fixed into the eleventh penetration hole (164) and the twelfth penetration hole (166); a combining part (174) protrudingly installed at the center of the fixing stand (106), having a thirteenth and a fourteenth penetration holes (170)(172) at the edge thereof; a seventh shaft (176) inserted and fixed into the thirteenth penetration hole (170) and the fourteenth penetration hole (172); a second loader (178) installed on the third shaft (144) and on the sixth shaft (169), configured to move the second rotation lever (138) and the fourth rotation lever (142); and a third loader (180) rotatably installed on the sixth shaft (169) and on the seventh shaft (176), and configured to move the first loader (168) and the second loader (178); the first armrest (184) installed at the upper part of the first vertical board (112); the second armrest (184) installed at the upper part of the second horizontal board (113) and the upper part; the sitting board for cushion installed at the upper part of the chair support (150); and the cushioned chair back installed at the upper part of the back board (162).

Figure 6:
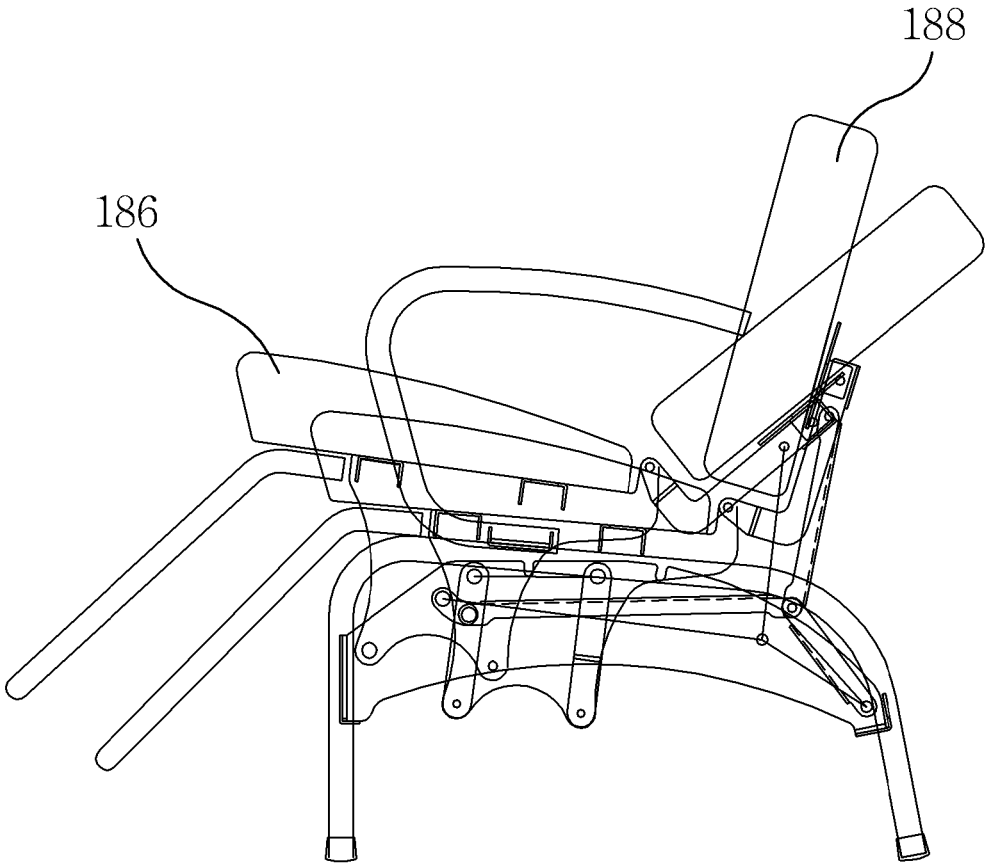
FIG. 6 is a sectional view showing the use of the sitting type shampoo chair of the present invention.
Figure 7:
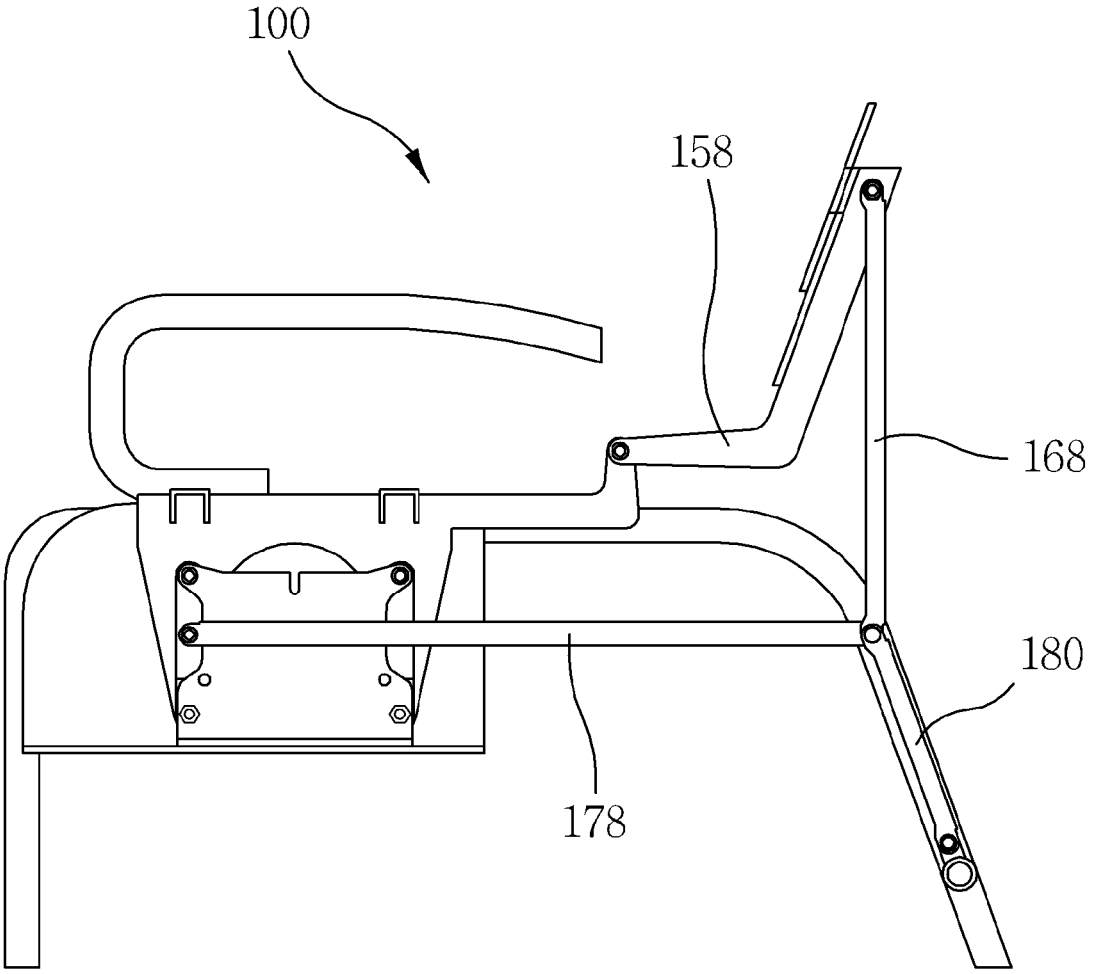
FIG. 7 and FIG. 8 are sectional views showing the use of the sitting type of shampoo chair frame of FIG. 6.
Figure 8:
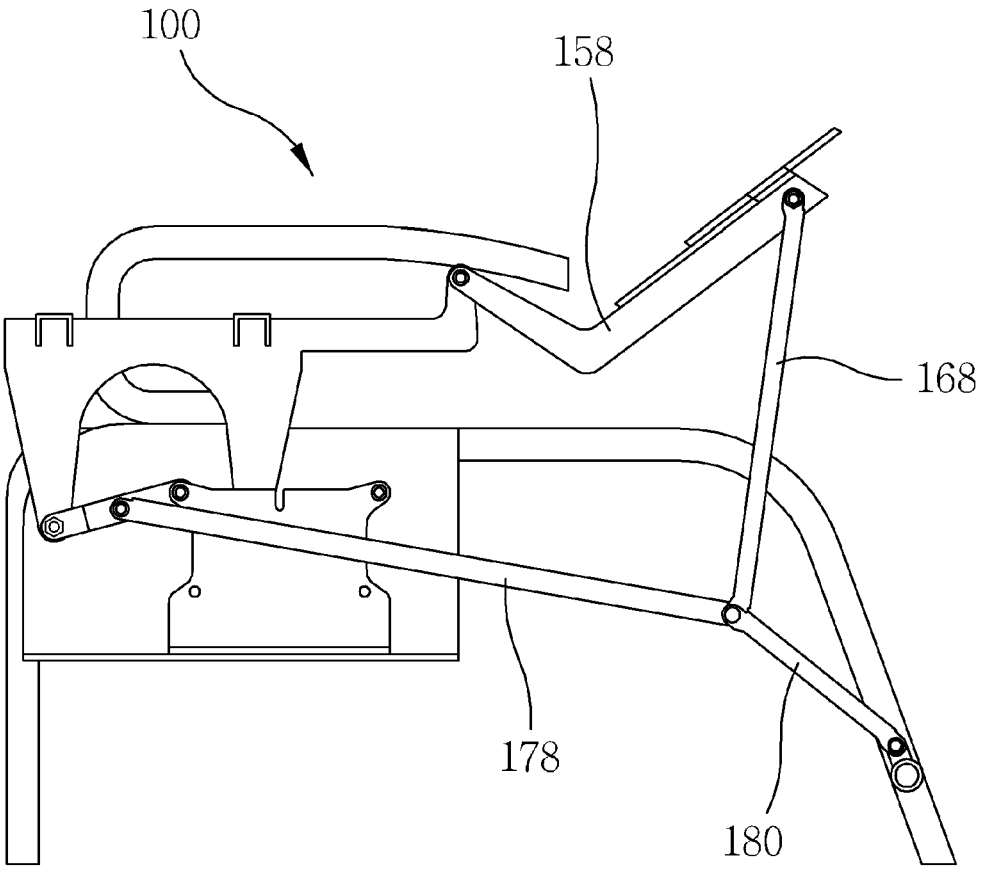
Figure 9:
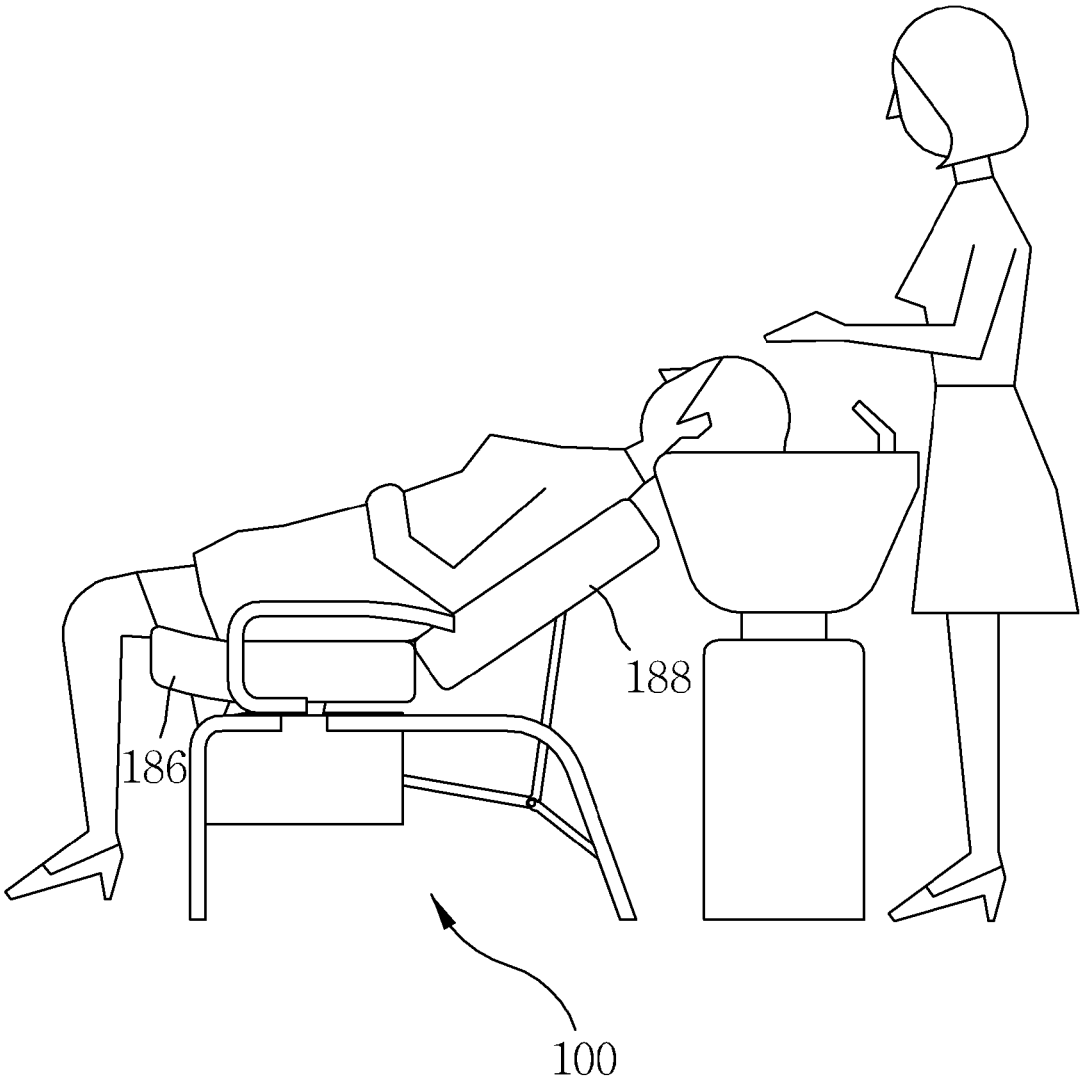
FIG. 9 is a view showing the user shampooing at the sitting type shampoo chair according to the present invention.

Referring to FIGS. 6 and 9, process of assembling the sitting type shampoo chair (100) comprised as follows.

First, position inverted U-shaped first leg frame (102) and position inverted U-shaped second leg frame (104) at a fixed distance from the inverted U-shaped first leg frame (102). Install fixing stand (106) at one part of rear side of the inverted U-shaped first leg frame (102) and at one part of rear side of the inverted U-shaped second leg frame (104). And install first bump piece (108) at one part of front side of the inverted U-shaped first leg frame (102), then install second bump piece (110) at one part of front side of the inverted U-shaped second leg frame (104). And install first horizontal plate (112) at one part of top side of the inverted U-shaped first leg frame (102), install second horizontal plate (113) at one part of top side of the inverted U-shaped second leg frame (104). And expansively install first lateral plate (114) vertically to the end of the first horizontal plate (112), then install the first lateral plate (114) at the end of first bump piece (108). And expansively install second lateral plate (116) vertically to the end of the second horizontal plate (113), and install the second lateral plate (116) to the end of second bump piece (110). And expansively install a support plate (118) horizontally to the end of the first lateral plate (114) and the end of second lateral plate (116), install the support plate (118) at the end of the first bump piece (108) and at the end of the second bump piece (110). And install first vertical plate (12) at one part of top side of the support plate (118), then install second vertical plate (122) at one part of top side of the support plate (118) at from a first vertical plate (120). Form the first and the second penetration holes (124) (126) at a fixed distance at one part of top side of the first vertical plate (120) and form the third penetration hole (128) at one part of top side of the second vertical plate (122) corresponding to the first penetration hole (124) of the first vertical plate (120) and form the fourth penetration hole (130) at one part of top side of the second vertical plate (122) corresponding to the second penetration hole (126) of the first vertical plate (120). And insert and fix first shaft (132) at the first penetration hole (124), third penetration hole (128), insert and fix second shaft (134) at the second penetration hole (126), fourth penetration hole (130).

Install first rotation lever (136) to be rotated at the end of one part of the second shaft (134), and install second rotation lever (138) to be rotated at the end of one part of the first shaft (132). Here, the second rotation lever (138) has fifth penetration hole (137). And install third rotation lever (140) to be rotated at the end of other part of the second shaft (134), install third rotation lever (140) to be rotated at the end of other part of the second shaft (134) first rotation lever (136), install fourth rotation lever (144) to be rotated at the end of other part of the first shaft (132). Here, the fourth rotation lever (142) the has sixth penetration hole (141) corresponding to fifth penetration hole (137). Insert third shaft (144) to the fifth penetration hole (137), sixth penetration hole (141) and fix that.

Position first guide (146) between the first lateral plate (114) and first vertical plate (120), install first rotation lever (136) and second rotation lever (138) at the lateral side of the first guide (146). Here the first guide (146) has seventh penetration hole (145) at its edge. And position second guide (148) between the second lateral plate (116) and second vertical plate (122), install third rotation lever (140) and fourth rotation lever (142) at the lateral side of the second guide (148). Here the second guide (148) has eighth penetration hole (147) at its edge.

Install chair support (150) at a fixed distance at top side of the first guide (146) and at top side of second guide (148).

Insert fourth shaft (152) to the seventh penetration (145) of the first guide (146) seventh (145) and eighth penetration hole (147) of second guide and fix them, install "L" shaped chair support (158) to be rotated at the end of one side and the end of other side of the fourth shaft (152). Here, there are ninth and tenth penetration holes (154)(156) at the edge of "L" shaped chair back support. Insert fifth shaft (160) at the ninth penetration hole (154) of the "L" shaped chair back support (158) and the tenth penetration hole (156) and fix them. Install chair back plate (162) to be rotated at the fifth shaft (160), install first loader (168) to be rotated at the fifth shaft (160). Here the first loader (168) has first and first 2 penetration holes (164)(166) at the edge.

Insert sixth shaft (169) to the first penetration hole (164) of the first loader (168) and the second penetration hole (166) of first loader (168) and fix them. Install combining part (174) at the center of the fixing stand 9106). Here the combining part (174) has third and fourth penetration holes (170) (172) at the edge. And insert seventh shaft (176) at the third penetration hole (170) of the combining part (174) and fourth penetration hole (172) of combining part (174) and fix them. Install second loader (178) at the third shaft (144) and sixth shaft (169). Install third loader (180) moving the first loader (168) and second loader (178) at the sixth shaft (169). Install first armrest (182) at the top side of the first horizontal plate (112), install second armrest (184) at the top side of the second horizontal plate (113), install cushioned seating plate (186) at the tope side of the chair support (150) and install cushioned chair back (188) at the top side of the chair back plate (162).

As the assembling sitting type shampoo chair according to present invention as above, if the user for shampooing hair sits on the cushioned seating plate (186) and positions the head on the washing stand, the user pushes cushioned chair back (188) backward. According to the movement of the cushioned chair back (188), the chair back plate (162) installed to be rotated as the fifth shaft (160) rotates. According to the rotation of the chair back plate (162), "L" shaped chair back support (158) connected to fourth shaft (152) rises up a bit and first loader 9168) installed to be rotated at fifth shaft (160) rotates and moves downward. According to the movement of the first loader (168), third loader (180) connected to sixth shaft (169) moves down. According to the movement of the third loader (180), the third loader (180) pushes second loader (178) connected to sixth shaft (169) forward to sitting type shampoo chair (100). According to the movement of the second loader (178), first rotation lever (136), second rotation lever (138), third rotation lever (140) and fourth rotation lever (142) move clockwise. According to the movement of the first rotation lever (136), second rotation lever (138), third rotation lever (140) and fourth rotation lever (142), first guide (146) and second guide (148) move up. According to the movement of the first guide (146) and second guide (148), the front part of cushioned seating plate installed at chair support (150) rises up a bit.

Conversely, after shampooing, if the user returns cushioned seating plate (186) to original position, the user pushes back cushioned seating plate. According to the movement of the cushioned seating plate (186), "L" shaped chair back support (158) connected to fourth shaft (152) goes down (original position, first loader (168) installed to be rotated at fifth shaft (160) rotates and moves up, when chair back plate (162) installed to be rotated at the fifth shaft (160) returns to original position. According to the movement of the first loader (168), third loader (180) connected to sixth shaft (169) moves up. According to the movement of the third (180), the third loader (180) pulls down second loader (178) connected to sixth shaft (169) backward to sitting type shampoo chair (100). According to the movement of the second loader (178), first rotation lever (136), second rotation lever (138), third rotation lever (140) and fourth rotation lever (142) move counter-clockwise. According to the movement of the first rotation lever (136), second rotation lever (138), third rotation lever (140) and fourth rotation lever (142), first guide (146) and second guide (148) move down. According to the movement of the first guide (146) and second guide (148), cushioned seating plate (186) installed at chair support (150) returns to the original position downward.

Figure 10:
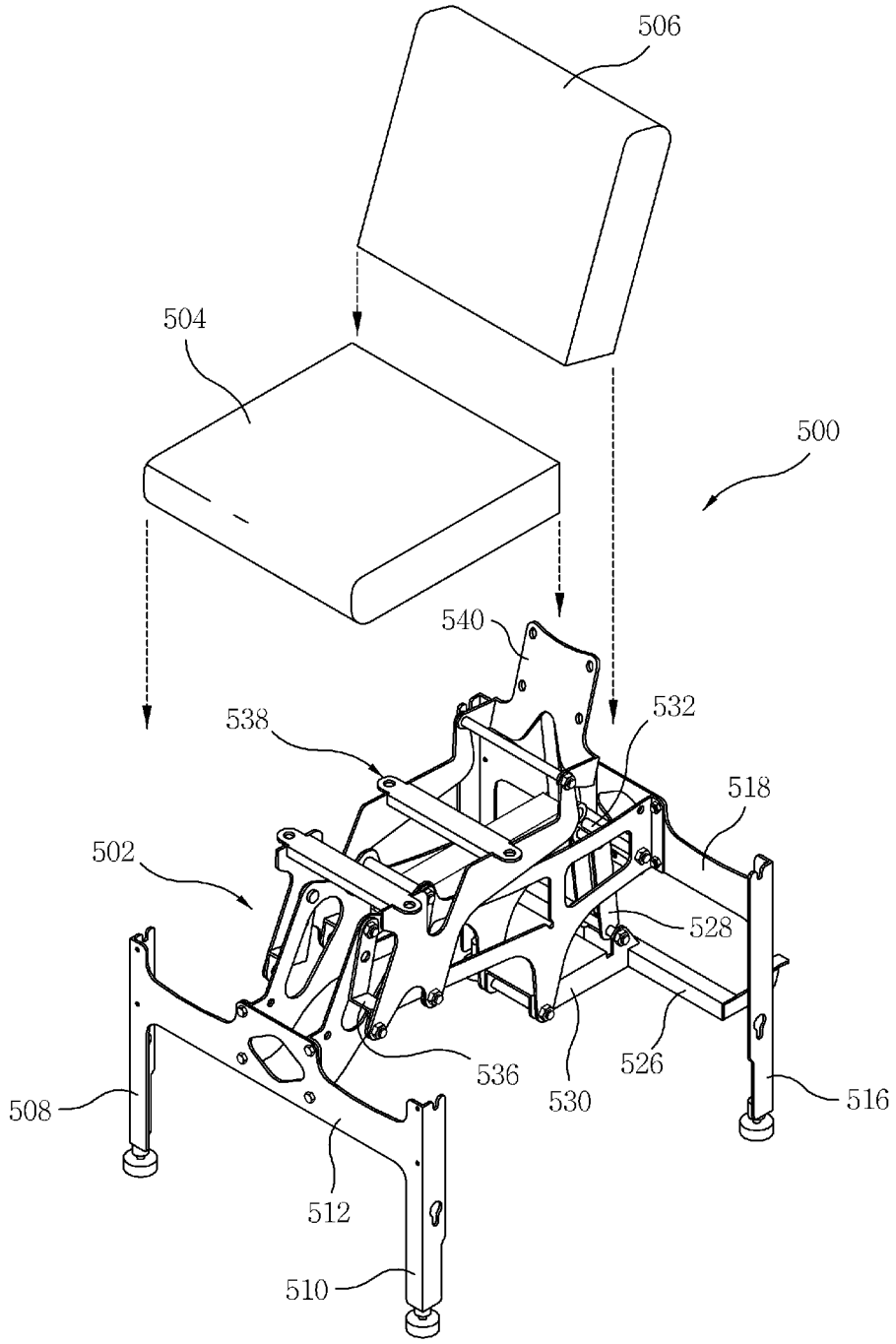
FIG. 10 is a partially exploded view of another embodiment of the sitting type shampoo chair according to the present invention.
Figure 11:
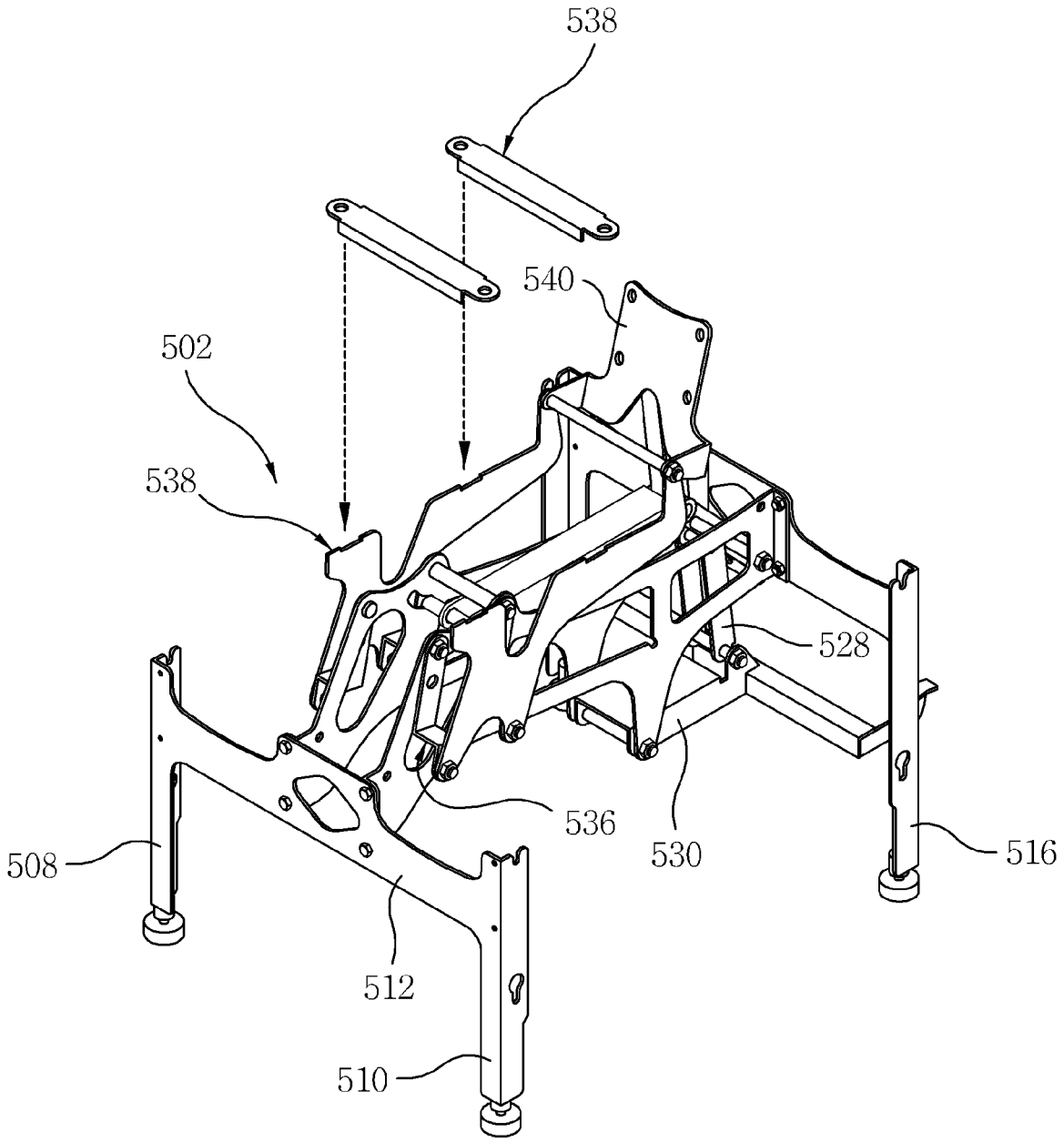
FIG. 11 is a partially exploded view showing FIG. 10 chair frame.
Figure 12:
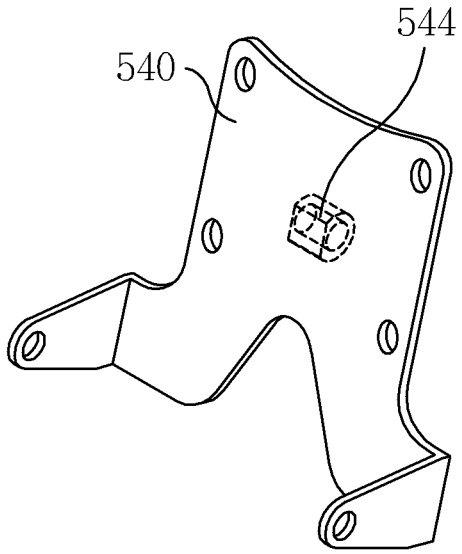
FIG. 12 is a sectional view showing the main part of FIG. 10 chair frame.
Figure 13:
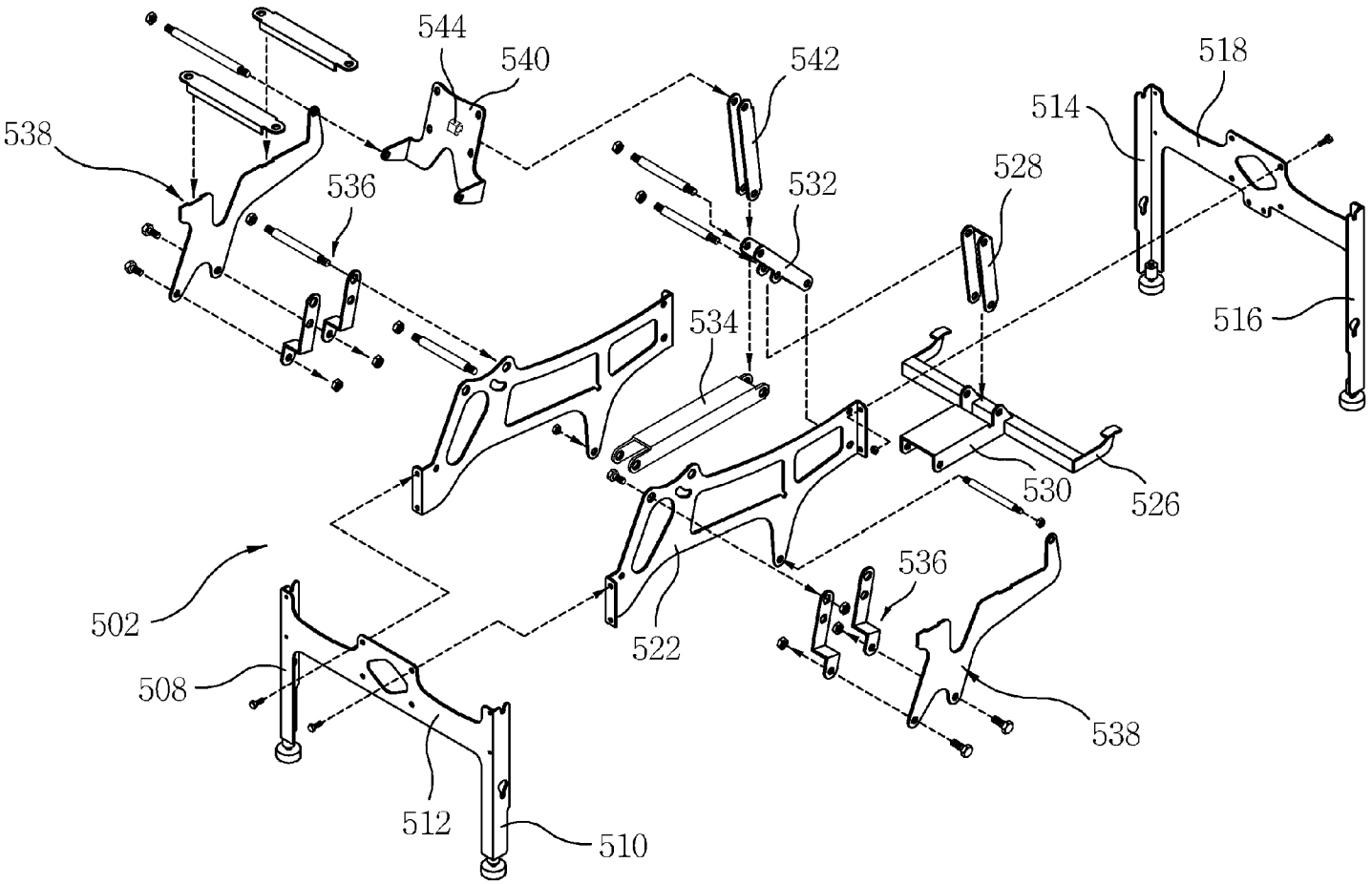
FIG. 13 is a view showing FIG. 10 chair frame.
Figure 14:
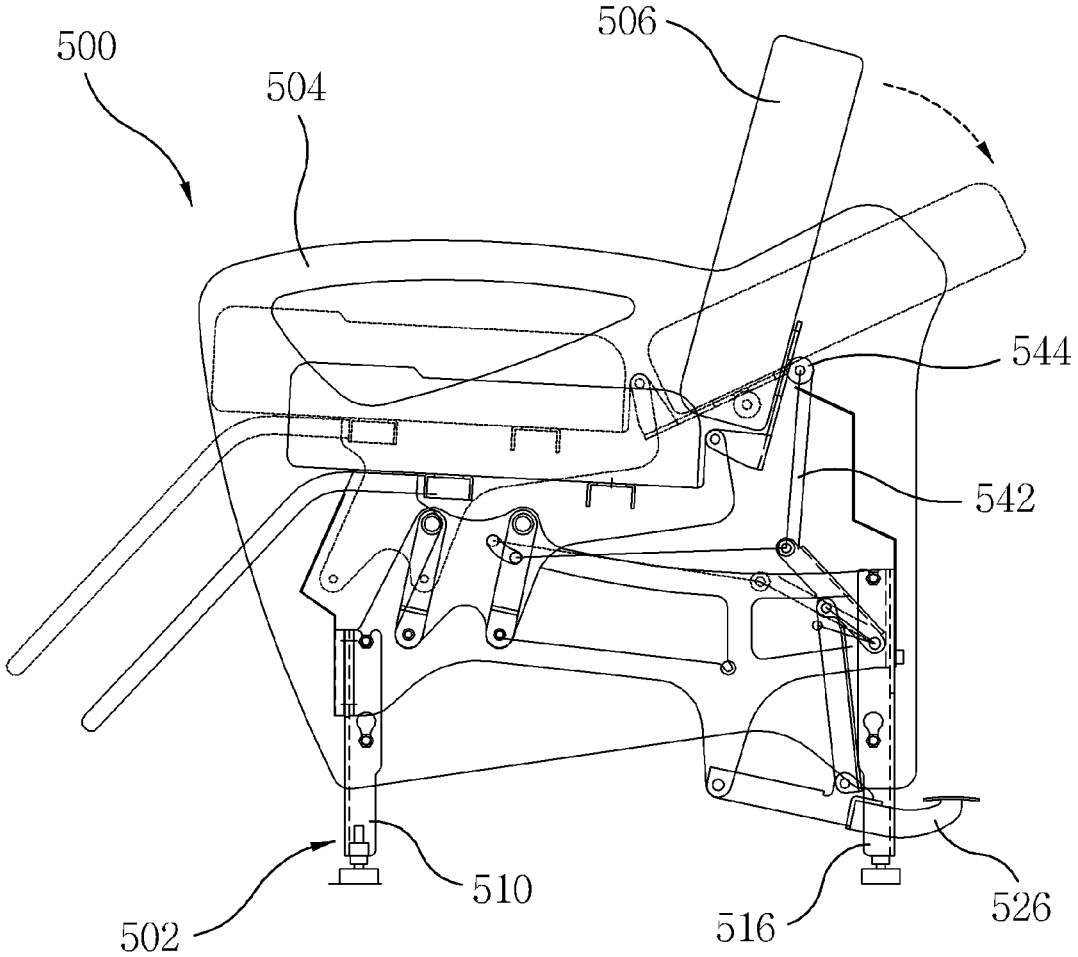
FIG. 14 is a drawing showing the use of FIG. 10 chair frame.

FIG. 10 is a partially exploded view of other embodiment of the sitting type shampoo chair according to the present invention. FIG. 11 is a partially exploded view showing FIG. 10 chair frame. FIG. 12 is a sectional view showing the main part of FIG. 10 chair frame. FIG. 13 is a view showing FIG. 10 chair frame. FIG. 14 is a drawing showing the use of FIG. 10 chair frame.

As illustrated at FIGS. 10 and 14, another embodiment of a sitting type shampoo chair (500) according to the present invention comprises a chair frame (502) having a chair support and a back support, each configured to be moved by operation of a foot support; a cushioned seating plate (504) installed on the chair support of the chair frame (502); and a cushioned chair back (506) installed on the back support of the chair frame (502), wherein the chair frame (502) comprises: a first leg (508); a second leg (510) positioned at a fixed distance from the first leg (508); a front side connecting rod (512) installed between the first leg (508) and the second leg (510); a third leg (514) positioned at a fixed distance from the second leg (508); a fourth leg (516) positioned at a fixed distance from the third leg (508); a rear side connecting rod (518) located between the third leg (514) and the fourth leg (516); a first support (520) installed between the front side connecting rod (512) and the rear side connecting rod (518); a second support (522) installed between the front side connecting rod (512) and the rear side connecting rod (518) at a fixed distance from the first support (520); a foot support (526) installed between the third leg (514) and the fourth leg (516) and configured to be moved upward or downward; a first vertical loader (528) installed at the foot support (526) and configured to be moved upward or downward by movement of the foot support (526); a first slant loader (530) installed slantly between the first support (520) and the second support (522) and configured to return the foot support (526) to an original position; a second slant loader (532) installed slantly on the first vertical loader (528) and configured to move upward or downward by movement of the first vertical loader (528); a horizontal loader (534) positioned between the first support (520) and the second support (522) and installed on the second slant loader (532) and configured to be moved forward or backward by movement of the second slant loader (532); a sliding means (536) configured to be slided up and down between a front side of the first support (520) and a front side of the second support (522), installed on the horizontal loader (534) and configured to be moved upward or downward by movement of sliding means (536); a chair support (538) installed on the sliding means (536) and configured to be moved upward or downward by movement of the sliding means (536), wherein the back support (540) is rotatably installed on the chair support (538); a second vertical loader (542) installed vertically on the second slant loader (532) and configured to be moved upward or downward by movement of the second slant loader (532); and a rotation roller (544) rotatably installed between the second vertical loader (542) and the back support (540) and configured to rotate the back support (540) by movement of the second vertical loader (542).

Process of assembling the sitting type shampoo chair (500) comprised as follows.

At first, position first leg (508) and position second leg (510) at a fixed distance from the first leg (508). And install front side connecting rod (512) between the first leg (508) and second leg (510). And position third leg (514) at a fixed distance from the first leg (508), position fourth leg (516) at a fixed distance from the third leg (508). And install rear side connecting rod (518) between the third leg (514) and fourth leg (516). And first support (520) between the front side connecting rod (512) and rear side connecting rod (518) and install second support (522) between the front side connecting rod (512) and rear side connecting rod (518) at from the first support (520). And position foot support (526) moving upward or downward between the third leg (514) and fourth leg (516), install first vertical loader (528) moving upward or downward according to the movement of the foot support (526) at foot support (526). Install slantly first slant loader (530) making the foot support (526) return to the original position between the first and second supports (520)(522) and foot support (526).

Install slantly second slant loader (532) moving upward or downward according to the movement of the first vertical loader (528) at the first vertical loader (528). And position horizontal loader (534) between the first support (520) and second support (522), install horizontal loader (534) advancing or reversing according to the movement of second slant loader (532) at the second slant loader (532). And install sliding means (536) to be slided up and down between the front side of the first support (520) and the front side of second support (522), install horizontal loader (534) at the sliding means (536). And install chair support (538) upward or downward according to the movement of sliding means (536) at the sliding means (536), install chair back support (540) to be met at the chair support (538). And install second vertical loader (542) moving upward or downward according to the movement of second slant loader (532) vertically to the second slant loader (532), install rotation roller (544) make chair back support (540) meet according to the movement of second vertical loader (542) at the second vertical loader (542).

As above, if assembling of the chair frame (502) making chair support and chair back support by operation of foot support is completed, install cushioned seating plate providing cushion to the chair support of the chair frame (502), install cushioned hair back (506) providing cushion to the chair back support of the chair frame (502).

After assembling of sitting type shampoo chair according to the present invention is completed, the present invention is used as follows.

When a client sits at cushioned seating plate (504) and is positioned at washing stand, the operator pushes cushioned chair back (188), press foot support (526) downward. According to the movement of the foot support (526) downward, first vertical loader (528) installed at the foot support (526) moves downward. And when the first vertical loader (538) moves downward, second slant loader (532) installed at first vertical loader (528) moves downward, the second slant loader (532) makes horizontal loader (534) frontward. Accordingly, the horizontal loader (534) advances. As the horizontal loader (534) moves forward, sliding means (536) connected the horizontal loader (534) moves upward.

And chair support (536) installed at the sliding means (536) moves upward, chair back support (540) installed to be met at the chair support (536) meets clockwise, the chair back support (540) rotates clockwise once again by rotation roller (544). So cushioned seating plate (504) is installed at the chair support (536) and cushioned chair back (506) is installed at chair back support (540) that the client positioned at the cushioned chair back meets clockwise and gets his or her head positioned at the same time.

What is claimed is:

1. A shampoo chair comprising:

a first leg frame;

a second leg frame positioned at a fixed distance from the first leg frame;

a fixing stand installed between a rear part of the first leg frame and a rear part of the second leg frame;

a first loader installed on one side of a third loader and configured to move a back support by movement of the third loader; and a second loader installed on one side of the third loader and configured to move a chair support by movement of the third loader, wherein the third loader is installed on one side of the fixing stand.

2. The shampoo chair of claim 1, further comprising:

a back board installed on a "L" shape back support and configured to be moved by movement of the "L" shape back support, wherein the first loader is configured to move the "L" shape back support by movement of the third loader.

3. The shampoo chair of claim 2, wherein the second loader is further installed on a first, a second, a third and a fourth rotation levers and configured to move the first, the second, the third and the fourth rotation levers by movement of the third loader, the first, the second, the third and the fourth rotation levers being installed on the second loader and on a chair support and configured to move the chair support by movement of the second loader.

4. A sitting type shampoo chair comprising:

an inverted U-shaped first leg frame;

an inverted U-shaped second leg frame positioned at a fixed distance from the inverted U-shaped first leg frame;

a fixing stand installed between a rear side of the inverted U-shaped first leg frame and a rear side of the inverted U-shaped second leg frame;

a first bump piece installed on a front side of the inverted U-shaped first leg frame;

a second bump piece installed on a front side of the inverted U-shaped second leg frame;

a first horizontal plate installed on a top side of the inverted U-shaped first leg frame;

a second horizontal plate installed on a top side of the inverted U-shaped second leg frame;

a first lateral plate extending vertically to one end of the first horizontal plate and installed to the first bump piece;

a second lateral plate extending vertically to one end of the second horizontal plate and installed to the second bump piece;

a support plate extending horizontally to one end of the first lateral plate and to one end of the second lateral plate, and installed on one end of the first bump piece and one end of the second bump piece;

a first vertical plate installed on an upper part of the support plate;

a second vertical plate located at a fixed distance from the first vertical plate and installed on the upper part of the support plate;

a first penetration hole and a second penetration hole located at a fixed distance on a top side of the first vertical plate;

a third penetration hole located at a top side of the second vertical plate corresponding to the first penetration hole on the first vertical plate;

a fourth penetration hole located at the top side of the second vertical plate corresponding to the second penetration hole of the first vertical plate;

a first shaft inserted and fixed to the first penetration hole and to the third penetration hole;

a second shaft inserted and fixed to the second penetration hole and to the fourth penetration hole;

a first rotation lever installed rotatably at the end of one side of the second shaft;

a second rotation lever installed rotatably at the end of one side of the first shaft and having a fifth penetration hole located at the center thereof;

a third rotation lever installed rotatably at the end of the other side of the second shaft;

a fourth rotation lever having a sixth penetration hole corresponding to the fifth penetration hole of the second rotation lever and located at the center thereof;

a third shaft inserted and fixed to the fifth penetration hole and the sixth penetration hole;

a first guide positioned between the first lateral plate and the first vertical plate, installed between the first rotation lever and the second rotation lever, configured to be moved by operation of the first and the second rotation levers and having a seventh penetration hole at the end of thereof;

a second guide positioned between the second lateral plate and the second vertical plate, configured to be moved by operation of the third and the fourth rotation levers, and having a eighth penetration hole at an end of thereof, wherein the third rotation lever and the fourth rotation lever are fixed to the second guide and;

a chair support installed at a fixed distance on a top side of the first guide and on a top side of the second guide;

a fourth shaft inserted and fixed into the seventh penetration hole and into the eight penetration hole;

a "L" shaped chair back support installed rotatably at one end of the fourth shaft, and having a ninth and a tenth penetration holes at the edge thereof;

a fifth shaft inserted and fixed at the ninth penetration hole and the tenth penetration hole;

a chair back plate configured to be rotated at the fifth shaft;

a first loader installed rotatably and vertically with a fixed length on the fifth shaft and configured to move the chair back plate and having an eleventh and a twelfth penetration holes at the edge thereof;

a sixth shaft inserted and fixed into the eleventh penetration hole and the twelfth penetration hole;

a combining part protrudingly installed at the center of the fixing stand, having a thirteenth and a fourteenth penetration holes at the edge thereof;

a seventh shaft inserted and fixed into the thirteenth penetration hole and the fourteenth penetration hole;

a second loader installed on the third shaft and on the sixth shaft, configured to move the second rotation lever and the fourth rotation lever; and a third loader rotatably installed on the sixth shaft and on the seventh shaft, and configured to move the first loader and the second loader.

5. A shampoo chair comprising:

a chair frame having a chair support and a back support, each configured to be moved by operation of a foot support;

a cushioned seating plate installed on the chair support of the chair frame; and a cushioned chair back installed on the back support of the chair frame, wherein the chair frame comprises:

the foot support configured to be moved upward or downward;

a first vertical loader installed at the foot support and configured to be moved upward or downward according to movement of foot support;

a second slant loader installed slantly to the first vertical loader and configured to be moved upward or downward according to movement of the first vertical loader;

a horizontal loader installed on the second slant loader and configured to be moved forward or backward according to movement of the second slant loader;

a sliding means installed on the horizontal loader and moving upward or downward according to movement of the horizontal loader; and a chair support installed on the sliding means and moving upward or downward according to movement of the sliding means.

6. The shampoo chair of claim 5, wherein the chair frame comprises;

a back support rotatably installed on the chair support;

a second vertical loader installed vertically to the second slant loader and configured to be moved upward or downward by movement of the second slant loader; and a rotation roller rotatably installed between the second vertical loader and the back support and configured to move the back support by movement of the second vertical loader.

7. A shampoo chair, comprising:

a chair frame having a chair support and a back support, each configured to be moved by operation of a foot support;

a cushioned seating plate installed on the chair support of the chair frame; and a cushioned chair back installed on the back support of the chair frame, wherein the chair frame comprises:

a first leg;

a second leg positioned at a fixed distance from the first leg;

a front side connecting rod installed between the first leg and the second leg;

a third leg positioned at a fixed distance from the second leg;

a fourth leg positioned at a fixed distance from the third leg;

a rear side connecting rod located between the third leg and the fourth leg;

a first support installed between the front side connecting rod and the rear side connecting rod;

a second support installed between the front side connecting rod and the rear side connecting rod at a fixed distance from the first support;

a foot support installed between the third leg and the fourth leg and configured to be moved upward or downward;

a first vertical loader installed at the foot support and configured to be moved upward or downward by movement of the foot support;

a first slant loader installed slantly between the first support and the second support and configured to return the foot support to an original position;

a second slant loader installed slantly on the first vertical loader and configured to move upward or downward by movement of the first vertical loader;

a horizontal loader positioned between the first support and the second support and installed on the second slant loader and configured to be moved forward or backward by movement of the second slant loader;

a sliding means configured to be slided up and down between a front side of the first support and a front side of the second support, installed on the horizontal loader and configured to be moved upward or downward by movement of sliding means;

a chair support installed on the sliding means and configured to be moved upward or downward by movement of the sliding means, wherein the back support is rotatably installed on the chair support;

a second vertical loader installed vertically on the second slant loader and configured to be moved upward or downward by movement of the second slant loader; and a rotation roller rotatably installed between the second vertical loader and the back support and configured to rotate the back support by movement of the second vertical loader.

* * * * *